428-919 SR
12/24/85 XR 4,560,608

United States Patent [19]
Pusch et al.

[11] Patent Number: 4,560,608
[45] Date of Patent: Dec. 24, 1985

[54] WINTER CAMOUFLAGE MATERIAL

[75] Inventors: Gunter Pusch, Bannholzweg 12, 6903 Neckargemund 2; Alexander Hoffmann, Mauer; Dieter E. Aisslinger, Geisenheim, all of Fed. Rep. of Germany

[73] Assignee: Gunter Pusch, Neckargemund, Fed. Rep. of Germany

[21] Appl. No.: 622,731

[22] Filed: Jun. 20, 1984

Related U.S. Application Data

[63] Continuation-in-part of Ser. No. 459,354, Dec. 16, 1982, Pat. No. 4,495,239, which is a continuation-in-part of Ser. No. 226,787, Jan. 21, 1981, Pat. No. 4,473,826.

[51] Int. Cl.[4] ..... B32B 3/00
[52] U.S. Cl. ..... 428/196; 428/145; 428/207; 428/209; 428/246; 428/248; 428/251; 428/252; 428/263; 428/284; 428/285; 428/287; 428/919

[58] Field of Search ..... 422/919, 246, 248, 251, 422/252, 264, 265, 268, 284, 285, 286, 195, 196, 207, 209

[56] References Cited

U.S. PATENT DOCUMENTS 4,308,882 1/1982 Pusch et al. ..... 428/919

FOREIGN PATENT DOCUMENTS 1605131 12/1981 United Kingdom .

*Primary Examiner*—James J. Bell
*Attorney, Agent, or Firm*—Michael N. Meller

[57] ABSTRACT

A woven or non-woven fabric is coated on both sides with a plastic material, followed by a vapor-deposited metal coating having a specific surface resistivity of 0.5 to 1.5 ohms per square, and then with a paint layer having a pattern of small areas of green and large areas of white to imitate a winter landscape and comprising a binder which is transparent in the spectral regions of atmospheric windows II (3–5 μm) and III (8–15 μm).

9 Claims, 1 Drawing Figure

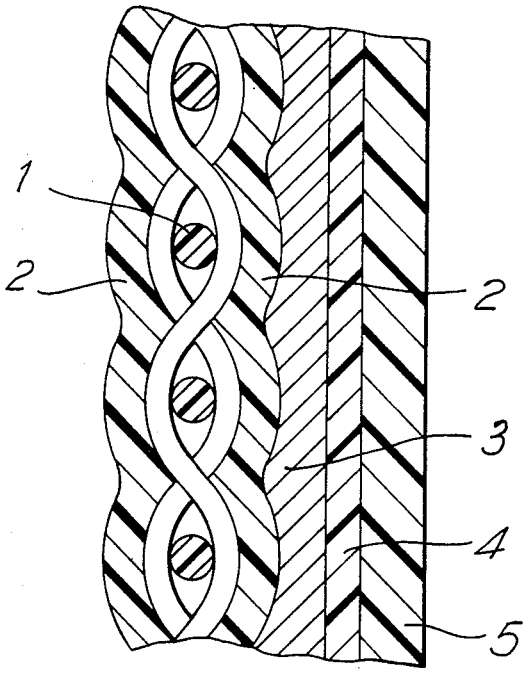
1
2
2
3
4
5

WINTER CAMOUFLAGE MATERIAL

CROSS REFERENCE TO RELATED APPLICATION

This application is a continuation-in-part of application Ser. No. 459,354 filed Dec. 16, 1982, now U.S. Pat. No. 4,495,239 which is a continuation-in-part of application Ser. No. 226,787 filed Jan. 21, 1981 now U.S. Pat. No. 4,473,826.

BACKGROUND OF THE INVENTION

The invention relates to a camouflage material for nets, blankets or clothing which is suitable for use during winter when the ground is snow covered. The object of the invention is to provide a protective camouflage material to prevent detection by visual, infrared and radar detection means and which is used primarily for military targets. When used as clothing it has the additional advantage of helping to keep people warm.

Known camouflage materials provide adequate protection in the visible and near-infrared range as well as in the far infrared region against detection by thermal imaging apparatus operating in the atmospheric windows II (3 to 5 μm) and III (8 to 14 μm). They are generally suitable for use in the warmer weather when emissivity in these windows must be adapted to blend in with that of the natural surroundings. The reflection coefficient of the garnishing material is adapted to the background and has a value of 0.1 to 0.3.

U.S. patent application Ser. No. 226,787 filed Jan. 21, 1981 relates to a camouflage material effective in the spectral range from visible light to radar waves having in sequence a fabric texture base, a soft plastic coating on the base, a metallic layer adhering to the plastic coating and a paint layer thereon wherein the metallic layer and paint layer in combination have an emission factor in the 3 to 5 μm spectral region of between 30 to 70% and in the 8 to 14 μm spectral region of between 40 to 85%.

U.S. application Ser. No. 459,354 filed Dec. 6, 1982 discloses a camouflage material of the above type comprising a base layer coated with a reflective conductive layer containing aluminum, copper or zinc which is reflective in the range of terrestrial thermal radiation and in the radar region of the spectrum and has a surface resistivity of not more than 0.5 to 10 ohms per square. This reflective layer is coated with a camouflage paint having reflective properties in the visible and near IR spectral regions similar to the natural warm background and incorporated in a binder having good transparency in windows II and III (3 to 5 μm and 8 to 14 μm, respectively). This reduces the emission contrast.

Applicant's British Pat. No. 1,605,131, published Dec. 16, 1981, discloses a camouflage object comprising a body having a surface which is highly reflective in the spectral ranges 3 to 5 μm (window II) and 8 to 14 μm (window III) and a coating of a camouflage paint on the highly reflecting surface. The paint contains a pigment having camouflage properties in the visible and near IR range and a binding agent and has an emissivity less than 90% in the spectral ranges of 3 to 5 μm and 8 to 14 μm. The emission power in windows II and III is "structured" by applying a priming paint comprising colors which are highly reflecting, in the manner of a clean metal surface, alternating with colors having a black effect in the long-wave IR range. "Structuring" may also be obtained by using a priming paint which is highly reflective and using a camouflage paint comprising pigments having different absorbing and/or scattering properties. A third method of "structuring" is obtained by using a primary paint which is highly reflecting and a camouflage paint with uniform pigmentation applied with locally different thicknesses. The binding agent suitably has a high absorption in the range from 5.5 to 7.5 μm. The patent also disclose the use of camouflage nets and thermal insulation mats treated in the same manner so as to be thermally structured.

U.S. Pat. No. 3,733,606 addresses the problem of detection by radar by using camouflage material consisting of a multi-layered material both absorbing and reflecting radar signals. At least one layer is a thin, non-homogeneous electrically conducting film having a surface resistivity at radio frequencies exceeding 2000 MHz of between 100 and 1000 ohms, but considerably different from 377 ohms, the characteristic impedance of free space, such as to establish reflection for at least 10% of the incident radar.

SUMMARY OF THE INVENTION

The present invention is based on the recognition that thermal imaging of snow, which has a temperature lower than 0° C., shows it to be a black body in the 3–5 μm and 8–15 μm atmospheric windows (II and III) for snow. Although in summer, camouflage is attained by merging the target into the background using nearly the same emissivity and reflectivity, in winter it is not possible to make the target as cold as snow. Therefore, the invention provides a deceptive camouflage whereby the apparent temperature of the target imitates the temperature of the snow whereas the actual temperature is not the same. The camouflage acts as a mirror reflecting the cold sky and snow, that is, the emissivity is quite a bit lower than that of snow. (Snow has an emissivity of 95% and the camouflage according to the invention has an emissivity of only about 50%).

The camouflage material according to the invention comprises a woven or non-woven material, coated on both sides with a layer of plastic coating and which is metallized on one side by vapor deposition. A printed coating of paint is applied to the metallized surface in white or in a pattern of grass green color separated by large spaces of white to imitate a snowy landscape.

Specifically the invention relates to a camouflage material comprising a base layer of a woven or non-woven fabric; a plastic coating on both sides of said fabric; a reflecting vapor-deposited metal layer on one side of said plastic-coated fabric, wherein the metal is selected from the group consisting of aluminum, tin and gold and the metal coating has a specific surface resistivity of 0.5 to 1.5 ohms per square; a camouflage paint layer of said metal layer, said paint layer having a pattern of green and white coloring materials in a binder having high transparency in the spectral regions of atmospheric windows II (3–5 μm) and III (8–14 μm); and preferably a colorless protective coating, on said metal layer, of a binder of said transparency which acts as a primer for the paint layer.

The material according to the invention reflects the cold snow and sky of winter independent of the wavelength, that is, the reflection in atmospheric windows II and III is the same. If the sun is shining in wintertime, the sun radiation is reflected much more in window II (3–5 μm) than in window III (8–14 μm). Therefore the reflection coefficient of the material is chosen lower in window II (30 to 70%) than in window III (40 to 85%).

BRIEF DESCRIPTION OF THE DRAWING

The drawing is a cross-sectional view of the winter camouflage material according to the invention.

DETAILED DESCRIPTION

The drawing shows the layers comprising the winter camouflage material of the invention comprising (a) a base layer of fabric 1 which may be made of natural or synthetic fibers, such as cotton, polyamide, polyester, polyethylene, polypropylene or glass fibers;

(b) a plastic coating 2 on both sides of the fabric, the coating being suitably selected from polyurethanes, plasticized PVC, silicone rubber and acrylic resins such as poly(butyl acrylate) and poly(methyl methacrylate);

(c) a metallized coating 3 of aluminum, tin or gold, deposited by vapor deposition;

(d) a protective coating 4 of a binder of the type used for the pigment layer 5; and (e) a very thin sprayed or printed pigment layer 5 comprising a pattern of green and white pigments in an IR transparent binder, such as shellac; chlorinated rubber, cyclic rubber; polyethylene copolymers, e.g., with vinyl acetates; PTFE; and chlorinated polypropylene.

Although the drawing illustrates the use of a woven fabric as the base layer, a non-woven fabric may also be used. The weight of the fabric is suitably 20 to 400 g/m$^2$. The preferred material is a polyamide.

The preferred plastic coating on both sides of the fabric is a plasticized PVC having a thickness of about 3 to 15 μm and consisting preferably of 1 part of poly(methyl methacrylate) and 2 parts of a copolymer consisting of 86% vinyl chloride, 13% vinyl acetate and 1% maleic acid.

Before metallizing, the plastic coated base layer is preferably passed through a glow discharge in a low vacuum so as to remove volatile particles from the surface. The vapor deposition may be carried out directly on the plastic coating or indirectly by metallizing a transfer film, for example, a polyester film provided with a release coat, and then placing the transfer film on the plastic coated fabric and roling to transfer the aluminum onto the plastic coated fabric. The preferred metal is aluminum in a thickness of 5 to 40 μm, preferably 30 μm. If the specific resistance of the metal reflecting layer is only about 0.5 to 1.5 ohms per square, this renders the material particularly effective against radar reconnaissance.

The protective coating over the metallized layer is a very thin layer (0.5 to 1 g/m$^2$) of an IR transparent synethetic material applied from an aromatic or aliphatic solvent. It also acts as a primer which improves the adhesion of the camouflage paint layer.

The pigments used in the paint layer are preferably ground with the binder and a solvent to obtain a particle size of less than 1 micron. Chromium oxide green and chromium oxide hydrate green are suitable green pigments and titanium dioxide and chalk are suitable white pigments. Green aniline dyes and soluble dyes, e.g. Neozapon Green, may be substituted for the green pigment. The pattern provides small areas of green and larger spaces of white to imitate a winter landscape. The thickness of the pigment layer is preferably 5 to 20 microns.

Flame retardants, such as antimony trioxide, may be included in the plastic or pigment layers.

The solvents used to prepare the solutions of the paints, coatings and binders used in the invention include methyl ethyl ketone, methyl isobutyl ketone, ethyl acetate, toluene, xylene and blends thereof depending upon the type of application such as spray coating, reverse coating, etc.

EXAMPLE 1

A 20% solution of 1 part of poly(methyl methacrylate) and 2 parts of a copolymer consisting of 86% vinyl chloride, 13% vinyl acetate and 1% maleic acid in methyl ethyl ketone was sprayed in an amount of 15 g/m$^2$ onto both sides of a woven nylon fabric of about 60 g/m$^2$. The fabric coated with the plasticized PVC was passed through a glow discharge under vacuum to remove volatile particles from the surface. Then it was metallized with aluminum by vapor disposition to a thickness of about 30 μm. The metallized surface was then coated with a primer of chlorinated polypropylene as a 30% solution in toluene to provide a coating of 1 g/m$^2$. After drying of the primer coating; a camouflage paint was applied in a pattern of small green areas and large white areas. The green pigment was chromium oxide green and the white pigment was titanium dioxide. These had been previously ground with some of the primer solution to obtain a particle size of less than 1 micron. The pigment layer had a thickness of 10 microns. The product had the structure as shown in the drawing.

EXAMPLE 2

A cotton fabric of 100 g/m$^2$ was coated on both sides with a silicone rubber in a thickness of about 10 microns. After treating with a glow discharge under low vacuum to remove volatile particles, the rubber coated fabric was metallized indirectly by rolling with an aluminized polyester transfer film previously coated with a release agent. The thickness of the transferred metallized coating was 25 microns. This was then coated with a protective layer of 0.5 g/m$^2$ of a polyethylene-vinyl acetate copolymer in methyl ethyl ketone. After drying, the coated fabric was then printed in a pattern as in Example 1 using Neozapon Green as a soluble green dyestuff and chalk as the white pigment. The colored paint also contained antimony trioxide as a flame retardant and was applied in a thickness of 5 microns.

We claim:

1. A winter camouflage material comprising a base layer of woven or non-woven fabric coated on both sides with a plastic material; a reflecting metal layer having a specific surface resistivity of 0.5 to 1.5 ohms per square, wherein the metal is selected from the group consisting of aluminum, tin and gold; and a white camouflage paint layer containing a white pigment and a binder which has high transparency in the spectral regions of atmospheric windows II (3–5 μm) and III (8–15 μm), said camouflage material having a reflection coefficient in the far infrared region of the spectrum of about 0.5 to 0.7.

2. The camouflage material according to claim 1, wherein said reflective layer consists of a homogeneous, conductive coating of aluminum produced by vapor deposition.

3. The camouflage material according to claim 1, further comprising a colorless protective coating on said metal layer of a binder having said transparency and which acts as a primer for said paint layer.

4. The camouflage material according to claim 1, wherein said binder is selected from the group consisting of shellac, chlorinated rubber, cyclic rubber, polyethylene copolymers, PTFE and chlorinated polypropylene.

5. The camouflage material according to claim 1, wherein said fabric is selected from the group consisting of cotton, polyamide, polyester, polyethylene, polypropylene and glass.

6. The camouflage material according to claim 1, wherein the white pigment is selected from the group consisting of chalk and titanium dioxide.

7. The camouflage material according to claim 1, wherein the camouflage paint layer is printed in a pattern of small areas of green color and large areas of white pigment.

8. The camouflage material according to claim 7, wherein the green color is selected from the group consisting of chromium oxide green, chromium oxide hydrate green, green aniline dyes, and green soluble dyes and the white pigment is selected from the group consisting of titanium dioxide and chalk.

9. The camouflage material according to claim 1, wherein the plastic material is selected from the group consisting of polyurethanes, plasticized PVC, silicone rubber and acrylic resins.

* * * * *